US009033754B2

(12) United States Patent
Gates

(10) Patent No.: US 9,033,754 B2
(45) Date of Patent: May 19, 2015

(54) RELEASABLE BINDING SYSTEMS

(71) Applicant: Craig D Gates, Mead, WA (US)

(72) Inventor: Craig D Gates, Mead, WA (US)

( * ) Notice: Subject to any disclaimer, the term of this patent is extended or adjusted under 35 U.S.C. 154(b) by 72 days.

(21) Appl. No.: 13/898,072

(22) Filed: May 20, 2013

(65) Prior Publication Data

US 2014/0342623 A1 Nov. 20, 2014

(51) Int. Cl.
*B63B 35/85* (2006.01)
*B63B 35/81* (2006.01)

(52) U.S. Cl.
CPC ..... *B63B 35/812* (2013.01)

(58) Field of Classification Search
CPC ..... B63B 35/812
USPC ..... 441/70; 280/611
See application file for complete search history.

(56) References Cited

U.S. PATENT DOCUMENTS

| | | | | |
|---|---|---|---|---|
| 3,909,028 | A * | 9/1975 | Courvoisier et al. | 280/613 |
| 4,758,191 | A | 7/1988 | Ackert et al. | |
| 4,863,408 | A * | 9/1989 | Lewis | 441/70 |
| 4,869,697 | A * | 9/1989 | Ackert et al. | 441/70 |
| 5,145,202 | A * | 9/1992 | Miller | 280/613 |
| 5,295,704 | A * | 3/1994 | Flock | 280/611 |
| 5,640,787 | A * | 6/1997 | Spademan | 36/117.3 |
| 5,785,566 | A * | 7/1998 | Blanger | 441/70 |
| 5,897,408 | A * | 4/1999 | Goode | 441/70 |
| 5,951,048 | A * | 9/1999 | Slaughter | 280/814 |
| 6,017,256 | A * | 1/2000 | Gillis et al. | 441/70 |
| 6,131,313 | A * | 10/2000 | Pierce et al. | 36/118.3 |
| 7,063,345 | B2 * | 6/2006 | Holzer | 280/611 |
| 7,841,614 | B2 * | 11/2010 | Damiani et al. | 280/611 |
| 8,060,945 | B2 * | 11/2011 | Adarraga | 2/22 |
| 8,171,570 | B2 * | 5/2012 | Adarraga | 2/22 |
| 2004/0145153 | A1 | 7/2004 | Holzer | |
| 2005/0194764 | A1 * | 9/2005 | Bluemel | 280/611 |
| 2006/0192365 | A1 * | 8/2006 | Ettlinger et al. | 280/611 |
| 2007/0080518 | A1 * | 4/2007 | Carvajal | 280/611 |
| 2007/0170695 | A1 * | 7/2007 | Damiani et al. | 280/617 |

FOREIGN PATENT DOCUMENTS

| | | | |
|---|---|---|---|
| WO | WO2007022328 | A1 | 2/2007 |
| WO | WO 2007022328 | A1 * | 2/2007 |

* cited by examiner

*Primary Examiner* — Lars A Olson
*Assistant Examiner* — Jovon Hayes
(74) *Attorney, Agent, or Firm* — Lee & Hayes, PLLC

(57) ABSTRACT

A releasable water ski binding system includes a trigger mechanism that causes releasable bindings to release a boot from a ski. The trigger mechanism senses a displacement of a portion of a body of a skier past a point of criticality and causes the releasable bindings to release the boot from the ski.

21 Claims, 6 Drawing Sheets

RELEASABLE BINDING SYSTEMS

BACKGROUND

For experienced, expert, and even recreational water skiers, water skiing can be a fast paced athletic event in which skiers move at high speeds across the water behind a boat. This is particularly true for slalom water skiing, where the skier skis on a single water ski or slalom ski. The boat is traveling at a high speed (e.g., 32 to 36 mph), and the slalom skier is commonly cutting back and forth across the boat's wake at even faster speeds (e.g., 40-70 mph). Expert skiers test their skills through a ski course in which the boat travels through a center path of buoys while the skier cuts side to side around a sequence of six buoys. It is not uncommon for water skiers, even expert ones, to fall during their ski runs. When high speeds are involved, the falls can result in injury to the skier. Traditionally, a skier placed his feet inside boots, which were fixedly attached to the slalom ski. During a crash, the ski would either remain on the skier's feet or fall off.

As the sport equipment evolved, slalom skies were constructed with more safety in mind for high-speed crashes. For instance, releasable bindings now exist that allow disconnection of boots from a ski in the event of a violent fall. Such bindings may disconnect the boots from the ski upon occurrence of a shearing motion of the skier relative to the ski, which may happen during a fall while the skier is crossing the boat wake. In certain situations, the violent falls involve the skier being displaced in a direction towards a front of the ski. This type of violent fall is known as an off the front (OTF) fall. In violent OTF falls, the existing bindings disconnect the boots and hence the skier from the ski, thereby attempting to prevent injury to the skier.

However, some of the violent falls do not involve a shearing motion of the skier relative to the ski. Instead, some of the violent falls involve a compression motion of the skier relative to the ski. For example, some of the violent falls involve the skier being displaced in a direction towards a top of the ski. A violent fall involving the skier being displaced in a direction towards a top of the ski is referred to in the skiing world as a crushing off the front (COTF) fall. In a violent COTF fall, the existing bindings fail and do not disconnect the boots from the ski, failing to prevent injury to the skier.

Moreover, because the COTF fall involves the skier being displaced in a direction towards a top of the ski, a weight of the skier and the compressive forces of deceleration are focused on a front foot of the skier, while a back foot of the skier is almost completely unloaded. Thus, a front ankle of the skier is forced to over-flex, and in many cases the skier ruptures his or her Achilles tendon, dislocates the peroneal tendon, fractures the front ankle, or some combination thereof.

Accordingly there remains a need in the art for a releasable binding system that disconnects the boots from the ski during violent falls involving a compression motion of the skier relative to the ski to prevent injury to the skier. Stated otherwise, there remains a need in the art for a releasable binding system that disconnects the boots from the ski during a COTF fall to prevent a front ankle of the skier from being forced to over-flex.

SUMMARY

Water ski binding systems and skis are configured to release one or more boots from a ski during a crushing off the front (COTF) fall. Generally, the releasing mechanism enables the boot(s) to disconnect from the ski when a portion of the skier's body displaces past a point of criticality. This summary is provided to introduce simplified concepts of releasable binding systems, which are further described below in the Detailed Description. This summary is not intended to identify essential features of the claimed subject matter, nor is it intended for use in determining the scope of the claimed subject matter.

In one example, a water ski binding system includes releasable bindings that removeably couple a boot to a ski, and a trigger mechanism to cause the releasable bindings to release the boot from the ski based at least in part on a displacement of a portion of a body of the skier over the boot toward a deck of the ski.

In another example, a water ski binding system includes a releasable binding system having a first binding component fixed to a releasable unit and a second binding component for affixation to a water ski. The water ski binding system also includes a trigger mechanism to cause the releasable binding system to release the releasable unit from the water ski based on a movement of a knee of the skier through a distance past an ankle below the knee.

In another example, a water ski binding system includes a releasable binding system having a first binding component fixed to a plate and a second binding component for affixation to a water ski. The water ski binding system includes a trigger mechanism to cause the releasable binding system to release the plate from the water ski based on a movement of a knee of the skier through a distance past an ankle below the knee.

In another example, a water ski boot system includes a releasable binding system having a first binding component and a second binding component for affixation to a water ski, and releasably coupling a first boot to the water ski. The water ski binding system includes a trigger mechanism to cause the releasable binding system to release the first boot from the water ski based on a movement of a knee of the skier through a distance past an ankle below the knee.

In another example, a slalom ski system includes releasable bindings removeably coupling a boot to a ski. The slalom ski system includes a trigger mechanism to cause the releasable bindings to release the boot from the ski based on a movement of a knee of a skier through a distance past an ankle below the knee.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
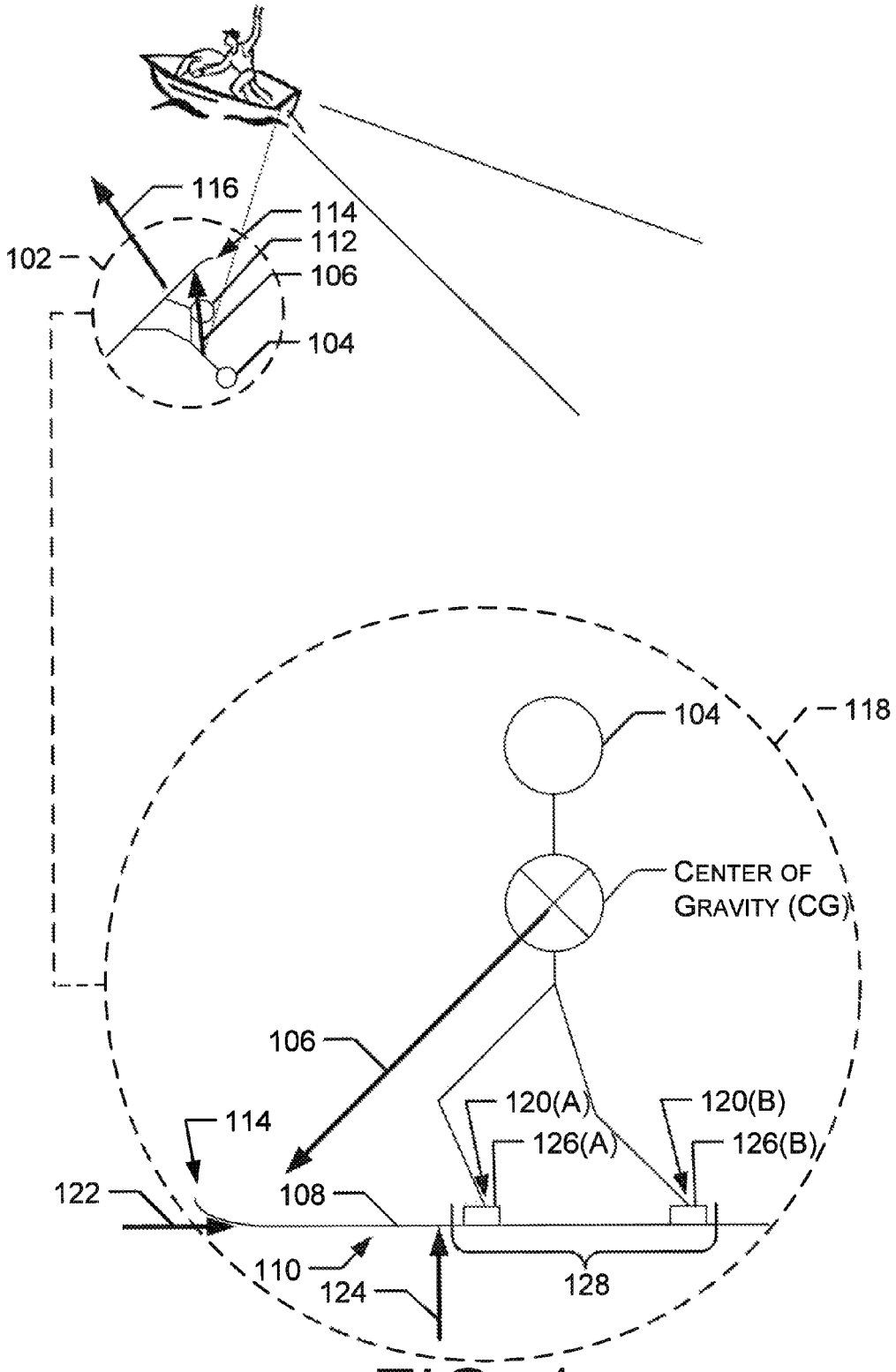
FIG. 1 illustrates an example crushing off the front (COTF) fall involving a skier being displaced in a direction towards a top of a ski.

This disclosure is directed to water ski binding systems and skis that disconnect a boot from a ski during a crushing off the front (COTF) fall to prevent injury, including injury to a front ankle of a skier that is forced to over-flex during the COFT. For example, the water ski binding systems may include a trigger mechanism to cause releasable bindings to release a boot from a ski based at least in part on a displacement of the skier's body over the boot toward a deck of the ski. For example, the trigger mechanism may cause releasable binding systems to release a boot from a ski based on movement of the skier's knee through a distance past an ankle below the knee. Stated otherwise, the trigger mechanism may base the releasing criteria on a position of a front knee of a slalom skier relative to a position of a front ankle of the slalom skier. Moreover, the trigger mechanism may employ a position sensor to continually sense the position of the front knee of the slalom skier relative to the position of the front ankle of the slalom skier. The trigger mechanism may cause a releasable binding system to release a boot from a ski to prevent the ankle from being forced to over-flex. In this way, the water ski binding systems disconnect a boot from the ski during violent falls involving a compression motion of the skier relative to the ski to prevent injury to the skier.

The water ski binding systems may include a releasable unit having a first boot arranged in front of a second boot and both boots fixedly attached to a plate. For example, the releasable unit may have a hard boot arranged in front of another hard boot and fixed to a plate. A hard boot as used herein is a substantially rigid boot that prevents a foot of a skier from exiting the substantially rigid boot. In the example, where the water ski binding system includes a releasable unit, a trigger mechanism may be arranged to cause release of the releasable unit from the water ski based on a movement of the skier's knee through a distance past an ankle below the knee. For example, the water ski binding system may have a member coupled to a knee strap and a release lever. The member to displace the release lever in response to a displacement of the knee through a distance past the ankle below the knee.

Further, the water ski binding system may include a releasable unit having a first soft boot arranged in front of a second soft boot, or a toe strap. For example, the water ski binding system may include a front soft boot fixed to a plate, and a rear soft boot or a toe strap fixed to the plate. A soft boot as used herein is a substantially flexible boot that allows a foot of a skier to exit the substantially flexible boot. In the example, where the water ski binding system includes a first soft boot and a second soft boot, or a toe strap, the water ski binding system may include safety straps to keep the feet of the skier in the soft boots. For example, the first soft boot may have a safety strap that keeps a front foot of the skier in the first soft boot during a fall, and the second soft boot, or toe strap may have another safety strap that keeps a back foot of the skier in the second soft boot or the toe strap during the fall.

Moreover, the water ski binding system may include a hard boot arranged in front of a soft boot, or a toe strap. For example, the water ski binding system may include a front hard boot removeably coupled to a ski and a toe strap fixed to the ski. Further, the water ski binding system may include a front hard boot removably coupled to a ski and a rear hard boot removably coupled to the ski. In the example, where the water ski binding system includes a hard boot removeably coupled to a ski, the water ski binding system may include a releasable binding system having a first binding component and a second binding component for affixation to a water ski, and to releasably couple the hard boot to the water ski. In the example, where the water ski binding system includes a hard boot removeably coupled to a ski, the water ski binding system may also include a trigger mechanism to cause the releasable binding system to release the hard boot from the water ski based on a movement of a knee of the skier through a distance past an ankle below the knee. For example, the trigger mechanism may have a lever fixed to the hard boot, and in response to a displacement of a knee of the skier through a distance past the ankle below the knee, the lever may cause the releasable binding system to release the hard boot from the water ski.

The water ski binding systems may include a releasable binding system having a first binding component fixed to a plate and second binding component for affixation to a water ski. The first binding component and the second binding component being matable to releasably couple the plate to the water ski. For example, the releasable binding system may include a socket-type mechanism fixed to the plate, and a mating pin-type mechanism for affixation to the water ski, or vise versa, to releasably couple the plate to the water ski. Moreover, the water ski binding system may include a hook and loop-type mechanism fixed to the plate, and a mating hook and loop-type mechanism for affixation to the water ski, to releasably couple the plate to the water ski.

Illustrative Water Ski Binding Systems

FIG. 1 illustrates an example crushing off the front (COTF) fall 102 involving a skier 104 being displaced in a direction 106 towards a deck 108 or top of a ski 110. For example, FIG. 1 illustrates a COTF fall 102 of the skier 104 attempting to go around a ball 112 of a slalom course. Further, while attempting to go around the ball 112, a tip 114 of the ski 110 is "stuffed" or forced down into the water, the ski 110 stops sideways to a direction of travel 116 of the skier 104, and momentum crushes the skier 104 downwards in the direction 106 towards the deck 108 of the ski 110 and towards the tip 114 of the ski 110. While FIG. 1 illustrates a COTF fall 102 where the tip 114 of the ski 110 is stuffed into the water, other types of COTF falls may occur. For example, a COTF fall may occur when the tip 114 of the ski 110 hits the ball 112, or the tail opposite the tip 114 is "skipped" or forced out of the water and the tip 114 catches the water. In most cases, the ski 110 is travelling relatively slowly, and a body of the skier 104 is moving down course while the ski 110 is beginning to, or has just suddenly started to, move cross course. As a result, a crushing is created by the drastic mismatch in the direction (e.g., down course vs. cross course) of the skier 104 and the ski 110.

Detail view 118 illustrates the COTF fall 102 in more detail, and shows a center of gravity (CG) of the skier 104 and compressive forces of deceleration are focused on a front foot 120(A) of the skier 104, while a back foot 120(B) of the skier 104 is almost completely unloaded. Detail view 118 illustrates the COTF fall 102 produce a force 122 applied along a length of the ski 110, and a force 124 applied on a bottom of the ski 110. The combined forces crushing the skier 104 downwards in the direction 106 towards the deck 108 of the ski 110 and towards the tip 114 of the ski 110. Until now, all releasable water ski bindings failed in the COTF fall 102. Stated otherwise, until now, all releasable water ski bindings did not disconnect boots 126(A) and/or 126(B) from the ski 110 in the COTF fall 102, thus failing to prevent injury to a skier. For example, until now, a front ankle of a skier is forced to over-flex, and in many cases the skier ruptures the Achilles Tendon, dislocates the peroneal tendon, fractures the front ankle, or some combination thereof.

This is because, until now, releasable bindings have been developed to allow disconnection of the boots and hence the skier from the ski based on a release load or breaking force. For example, in the COTF fall 102 a total load on a release mechanism (e.g., a pin and socket-type release mechanism, a hook and loop-type release mechanism, a pivot-type release mechanism etc.) is below the release threshold of the release mechanism, and thus the releasable bindings fail to release the skier from the ski. For example, a total load on a spring of a pin and socket-type release mechanism is below the release threshold of the spring, and the pin and socket-type release mechanism will not release. Thus, forcing a front ankle of a skier to over-flex in a COTF fall.

FIG. 1 illustrates the ski 110 includes a water ski binding system 128 that disconnects boots 126(A) and/or 126(B) from the ski 110 during the COTF fall 102. The water ski binding system 128 may use a position sensor to continually sense an angle between the front lower leg and the front foot. If the angle becomes too acute, to the point that the Achilles tendon or other parts of the ankle and lower leg are at risk, the water ski binding system 128 may disconnect the front boot 126(A) and/or the rear boot 126(B). For example, the position sensor may be any device that measures the position of the front knee relative to the front ankle, and converts that position to a force reduction mechanism that partially or wholly defeats a release mechanism (e.g., a pin and socket-type release mechanism, a hook and loop-type release mechanism, a pivot-type release mechanism etc.). The position sensor may be mechanical or electromechanical. For example, a mechanical position sensor may be a lanyard, a lever, a gear or the like that senses when the knee is too far ahead of the ankle An electromechanical position sensor may include an electronic proximity sensor (e.g., an inductive sensor), a capacitive displacement sensor, a Hall Effect sensor, an optical proximity sensor, a rotary encoder, a string potentiometer etc. that senses when the knee is too far ahead of the ankle.

Figure 2:
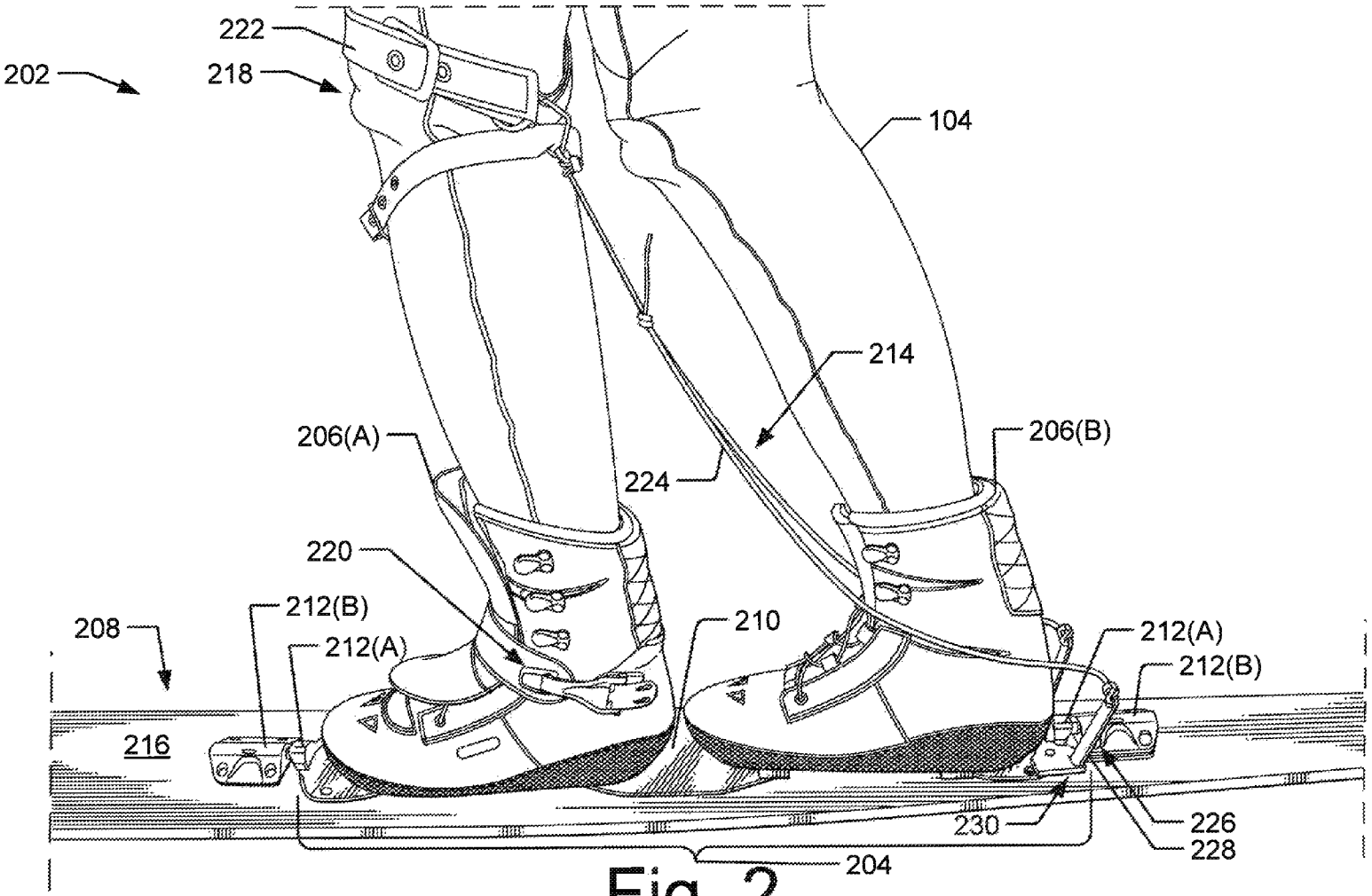
FIG. 2 illustrates a perspective view of an example water ski binding system having a releasable unit that disconnects boots from a ski during the example COTF fall shown in FIG. 1.

FIG. 2 illustrates a perspective view of an example water ski binding system 202 having a releasable unit 204 that disconnects boots 206(A) and 206(B) from a ski 208 during the example COTF fall 102 shown in FIG. 1. While FIG. 2 illustrates the first and second boots 206(A) and 206(B) fixed to a plate 210, the first and second boots 206(A) and 206(B) may not be fixed to the plate 210. For example, the first boot 206(A) may be fixed to a plate, while the second boot 206(B) may be fixed to the ski 208. Moreover, the first boot 206(A) may be fixed to the plate 210, and a toe strap may be fixed to the plate 210 instead of the second boot 206(B). Moreover, the first and second boots 206(A) and 206(B) may comprise hard boots, semi hard boots, and/or soft boots fixed to the plate 210. For example, the first and second boots 206(A) and 206(B) may comprise hard boots fixed to the plate 210.

FIG. 2 illustrates a releasable binding system having a first binding component 212(A) fixed to the releasable unit 204 and a second binding component 212(B) for affixation to the ski 208. The first binding component 212(A) and the second binding component 212(B) being matable to releasably couple the releasable unit 204 to the ski 208. For example, the releasable binding system may have the first binding component 212(A) fixed to the plate 210 and the second binding component 212(B) for affixation to the ski 208. The first binding component 212(A) and the second binding component 212(B) being matable to releasably couple the plate 210 to the ski 208.

FIG. 2 illustrates the releasable binding system comprising a pin and socket-type releasable binding system. For example, FIG. 2 illustrates the first binding component 212(A) fixed to the releasable unit 204 comprising a socket-type binding component, and the second binding component 212(B) for affixation to the ski 208 comprising a pin-type binding component. While FIG. 2 illustrates a pin and socket-type releasable binding system (e.g., a "Stealth" brand releasable binding system from Connelly), the releasable binding system may be any type of releasing plate binding. For example, the releasable binding system may be a hook and loop-type releasable binding system (e.g., an "Inter-Loc™" brand releasable binding system from Goode), a pin and socket-type releasable binding system (e.g., a "Diablo" brand releasable binding system from Fogman), a pivot-type releasable binding system (e.g., a "Revo" brand releasable binding system from Fluid Motion) etc.

FIG. 2 illustrates a trigger mechanism 214 to cause the releasable binding system to release the releasable unit 204 from the ski 208 based at least in part on a displacement of a portion of a body of the skier 104 over the front boot 206(A) toward a deck 216 of the ski 208. For example, the trigger mechanism 214 may cause the releasable binding system to release the plate 210 from the ski 208 based on a movement of a knee 218 of the skier 104 through a distance past an ankle 220 below the knee 218. While FIG. 2 illustrates the trigger mechanism 214 arranged to cause the releasable binding system to release the releasable unit 204 from the ski 208, the trigger mechanism 214 may cause the releasable binding system to release the front boots 206(A) from the ski 208 based at least in part on a displacement of a portion of a body of the skier 104 over the front boot 206(A) toward a deck 216 of the ski 208. For example, the front boot 206(A) may be fixed to a plate (e.g., plate 210), and the back boot 206(B) (e.g., a soft boot) or toe strap may be fixed to the ski, and trigger mechanism 214 may be arranged to cause a releasable binding system to release the front boot 206(A).

FIG. 2 illustrates the trigger mechanism 214 including a knee strap 222 coupled to the knee 218 of the skier 104. While FIG. 2 illustrates the knee strap 222 comprising straps arranged around the knee 218, the knee strap 222 may be a sleeve, a brace, a bracket, a portion of a wetsuit, an extension from the front boot, or any other attachment mechanism that couples to a knee. FIG. 2 illustrates a member 224 coupled to the knee strap 222 and a release lever 226. The member 224 displaces the release lever 226, in response to the displacement of the portion of the body of the skier 104 over the front boot 206(A) toward the deck 216 of the ski 208, to cause the releasable bindings to release the releasable unit 204 from the ski 208. The member 224 may be selectively adjustable by the skier 104. For example, the member 224 may be selectively adjusted based on a body proportion of a skier. For example, the member 224 may be adjusted based on a size (e.g., a length) of a leg of the skier and/or a flexibility of the skier.

While FIG. 2 illustrates the member 224 comprising a lanyard (e.g., a string, a lace, a line, etc.), the member 224 may be any mechanical sensor that senses when the knee 218 is too far ahead of the ankle 220 and converts that position to a force reduction mechanism that partially or wholly defeats a total load on a release mechanism (e.g., a pin and socket-type release mechanism, a hook and loop-type release mechanism, a pivot-type release mechanism etc.) to cause the releasable bindings to release the releasable unit 204 from the ski 208. For example, the member 224 may be a cable, a bar, a gear(s), lever(s) or the like arranged to senses when the knee 218 is too far ahead of the ankle 220 and cause the releasable bindings to release the releasable unit 204 from the ski 208. For example, gears and/or levers may be arranged with the front boot 206(A) that measures a displacement (e.g., a rotation) of the leg and/or ankle 220 inside the front boot 206(A). The sensed rotational displacement of the leg and/or ankle 220 inside the front boot 206(A) determining when the knee 218 is too far ahead of the ankle 220 and causing the releasable bindings to release the releasable unit 204 from the ski 208.

Moreover, while FIG. 2 illustrates the member 224 comprising a mechanical sensor that senses when the knee 218 is too far ahead of the ankle 220 and converts that position to a force reduction mechanism that partially or wholly defeats a total load on a release mechanism to cause the releasable bindings to release the releasable unit 204 from the ski 208, the member 224 may be an electromechanical sensor. For example, an electromechanical sensor may sense when the knee 218 is too far ahead of the ankle 220 and converts that position to a force reduction mechanism that partially or wholly defeats a total load on a release mechanism to cause the releasable bindings to release the releasable unit 204 from the ski 208. For example, the member 224 may be an electronic proximity sensor (e.g., an inductive sensor), a capacitive displacement sensor, a Hall effect sensor, an optical proximity sensor, a rotary encoder, a string potentiometer that senses when the knee 218 is too far ahead of the ankle 220 and causes the releasable bindings to release the releasable unit 204 from the ski 208. For example, the member 224 may comprise an electromechanical sensor arranged in the front boot 206(A) and configured to measure a displacement (e.g., a rotation) of the ankle 220 inside the front boot 206(A). The sensed rotational displacement of the ankle 220 inside the front boot 206(A) determining when the knee 218 is too far ahead of the ankle 220 and causing the releasable bindings to release the releasable unit 204 from the ski 208.

FIG. 2 illustrates the release lever 226 is fixed to the plate 210 and may include a lever arm 228 and a cam 230. The cam 230 may be arranged between the plate 210 and the deck 216 of the ski 208. In response to the movement of the knee 218 of the skier 104 through the distance past the ankle 220 below the knee 218, the member 224 displaces the lever arm 228 and the cam 230 to cause the releasable binding system to release the releasable unit 204 from the ski 208. For example, in response to the movement of the knee 218 of the skier 104 through the distance past the ankle 220 below the knee 218, the member 224 displaces the lever arm 228 and the cam 230 to partially or wholly defeat a total load on a release mechanism (e.g., a pin and socket-type release mechanism, a hook and loop-type release mechanism, a pivot-type release mechanism etc.) to cause the releasable bindings to release the releasable unit 204 from the ski 208.

While FIG. 2 illustrates the trigger mechanism 214 having a force reduction mechanism comprising release lever 226 that partially or wholly defeats a total load on a release mechanism to cause the releasable bindings to release the releasable unit 204 from the ski 208, the trigger mechanism 214 may have any other force reduction mechanism that partially or wholly defeats a total load on a release mechanism to cause the releasable bindings to release the releasable unit 204 from the ski 208. For example, the trigger mechanism 214 may include a wedge, a screw thread, a hydraulic cylinder, a hydraulic bag, an airbag or the like arranged to partially or wholly defeat a total load on a release mechanism to cause the releasable bindings to release the releasable unit 204 from the ski 208. For example, the trigger mechanism 214 may include an airbag arranged between the plate 210 and the deck 216 of the ski 208, that when inflated, partially or wholly defeats a total load on a release mechanism to cause the releasable bindings to release the releasable unit 204 from the ski 208.

Figure 3:
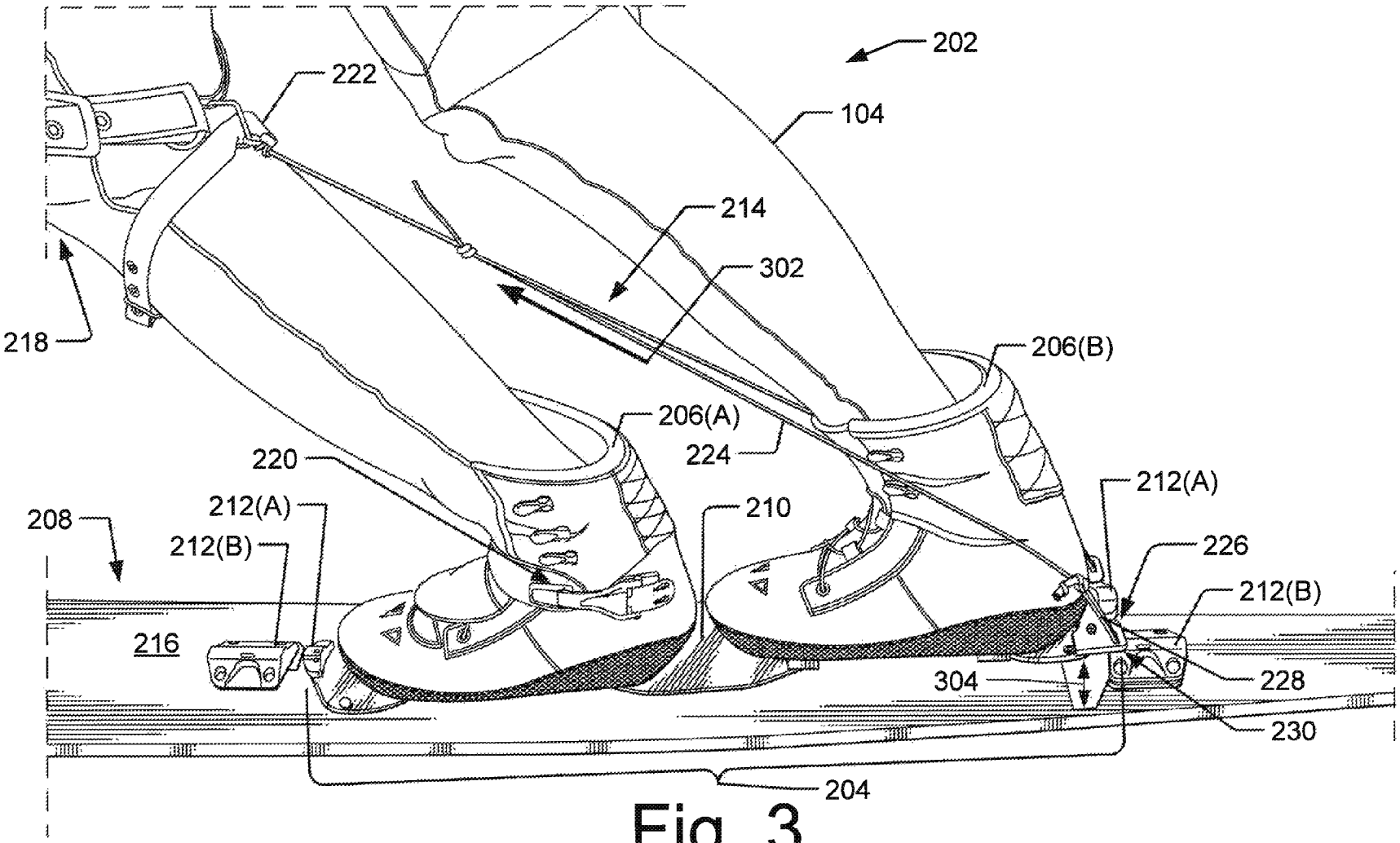
FIG. 3 illustrates a perspective view of the example water ski binding system shown in FIG. 2 with the releasable unit decoupled from the ski.

FIG. 3 illustrates a perspective view of the example water ski binding system 202 shown in FIG. 2 with the releasable unit 204 decoupled from the ski 108. FIG. 3 illustrates the trigger mechanism 214 causing the releasable binding system to release the releasable unit 204 from the ski 208 based on a movement of the knee 218 of the skier 104 through a distance past the ankle 220 below the knee 218. For example, FIG. 3 illustrates the release lever 226 displaced in a direction 302 toward the knee 218 causing the release lever 226 to partially or wholly defeat a total load on a release mechanism of the first and second binding components 212(A) and 212(B) of the releasable binding system. Moreover, the lever arm 228 rotates the cam 230 of the release lever 226 to force the plate 210 a distance 304 away from the deck 216 of the ski 208. The rotation of the cam 230 overcoming a total load on a release mechanism (e.g., a pin and socket-type release mechanism, a hook and loop-type release mechanism, a pivot-type release mechanism etc.) and causing the first and second binding components 212(A) and 212(B) to release the releasable unit 204 from the ski 208.

Figure 4:
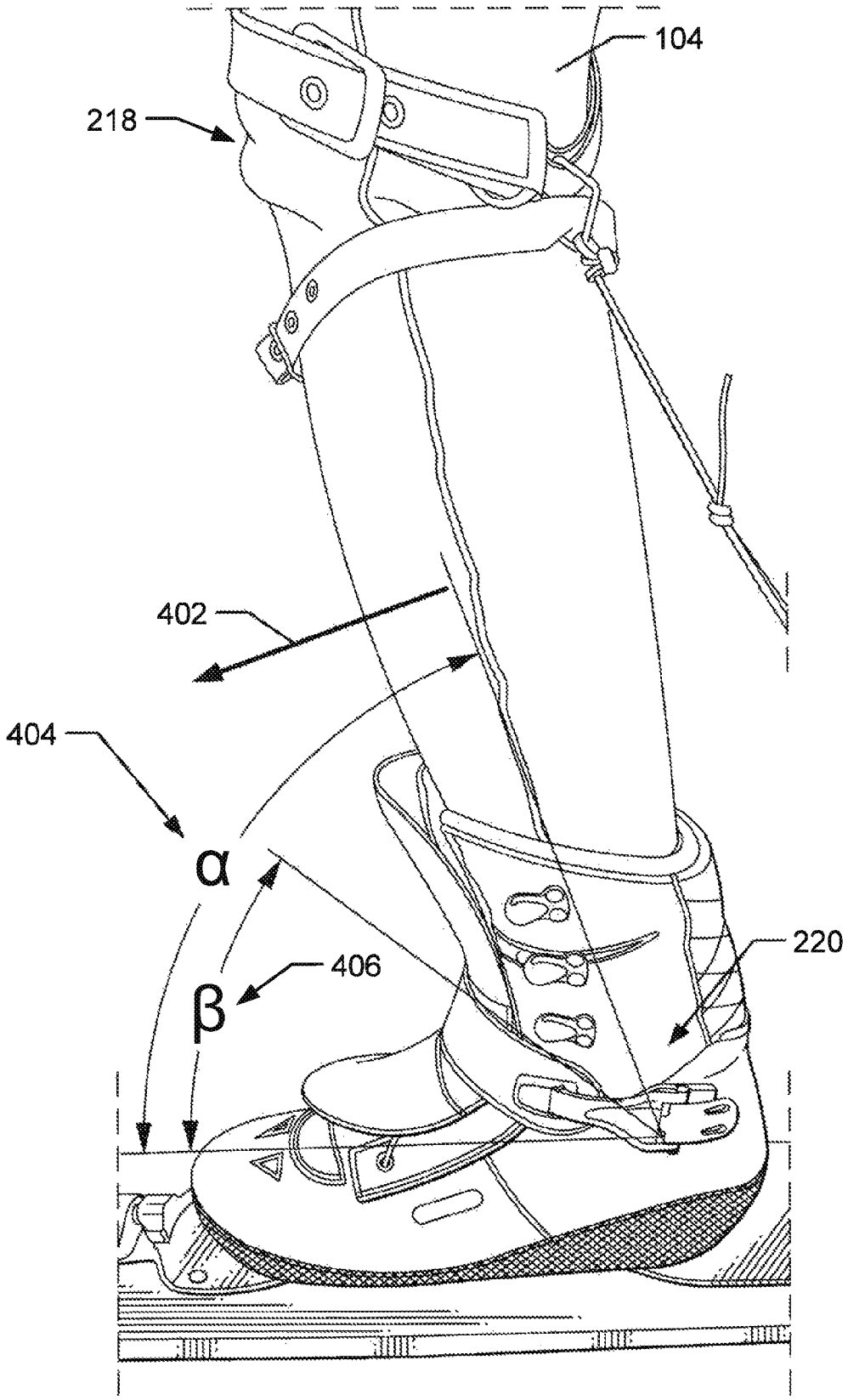
FIG. 4 illustrates a detail view of an example displacement of a portion of a body of a skier over a boot toward a deck of the ski that the example water ski binding system shown in FIGS. 2 and 3 measures to release a boot from a ski during the example COTF fall shown in FIG. 1.

FIG. 4 illustrates a detail view of an example displacement of a portion of a body of a skier over a boot toward a deck of the ski that the example water ski binding system shown in FIGS. 2 and 3 measures to release a boot from a ski during the example COTF fall 102 shown in FIG. 1. For example, FIG. 4 illustrates a movement 402 of the knee 218 of the skier 104 through a distance 404 past the ankle 220 below the knee 218. FIG. 4 illustrates the distance 404 being measured via an angle ($\alpha$) of the knee 218 relative to the ankle 220. When the water ski binding system 202 measures the angle ($\alpha$) is less than or equal to a limiting distance 406 measured via a limiting angle ($\beta$) of the knee 218 relative to the ankle 220, the water ski binding system 202 releases a boot from a ski during the example COTF fall 102. Further, a measurement of the angle ($\alpha$) is less than or equal to limiting angle ($\beta$) results in a dramatic release force reduction. Stated otherwise, measurement of the angle ($\alpha$) is less than or equal to limiting angle ($\beta$) results in a trigger mechanism (e.g., trigger mechanism 214) overcoming a total load on a release mechanism (e.g., a pin and socket-type release mechanism, a hook and loop-type release mechanism, a pivot-type release mechanism etc.) and causing binding components (e.g., first and second binding components 212(A) and 212(B)) to release a releasable unit (e.g., releasable unit 204) from a ski (e.g., ski 208).

The limiting distance 406 measured via the limiting angle ($\beta$) of the knee 218 relative to the ankle 220 defines a maximum limit of an Achilles tendon, a peroneal tendon, the ankle 220, or like of the skier 104. For example the limiting angle ($\beta$) of the knee 218 relative to the ankle 220 defines when the Achilles tendon ruptures, the peroneal tendon is dislocated, or the ankle 220 fractures. Moreover, the limiting angle ($\beta$) of the knee 218 relative to the ankle 220 is dependent on the skier 104. For example, the limiting angle ($\beta$) of the knee 218 relative to the ankle 220 is dependent of a size (e.g., a length) of a leg of the skier and/or a flexibility of the skier.

Figure 5:
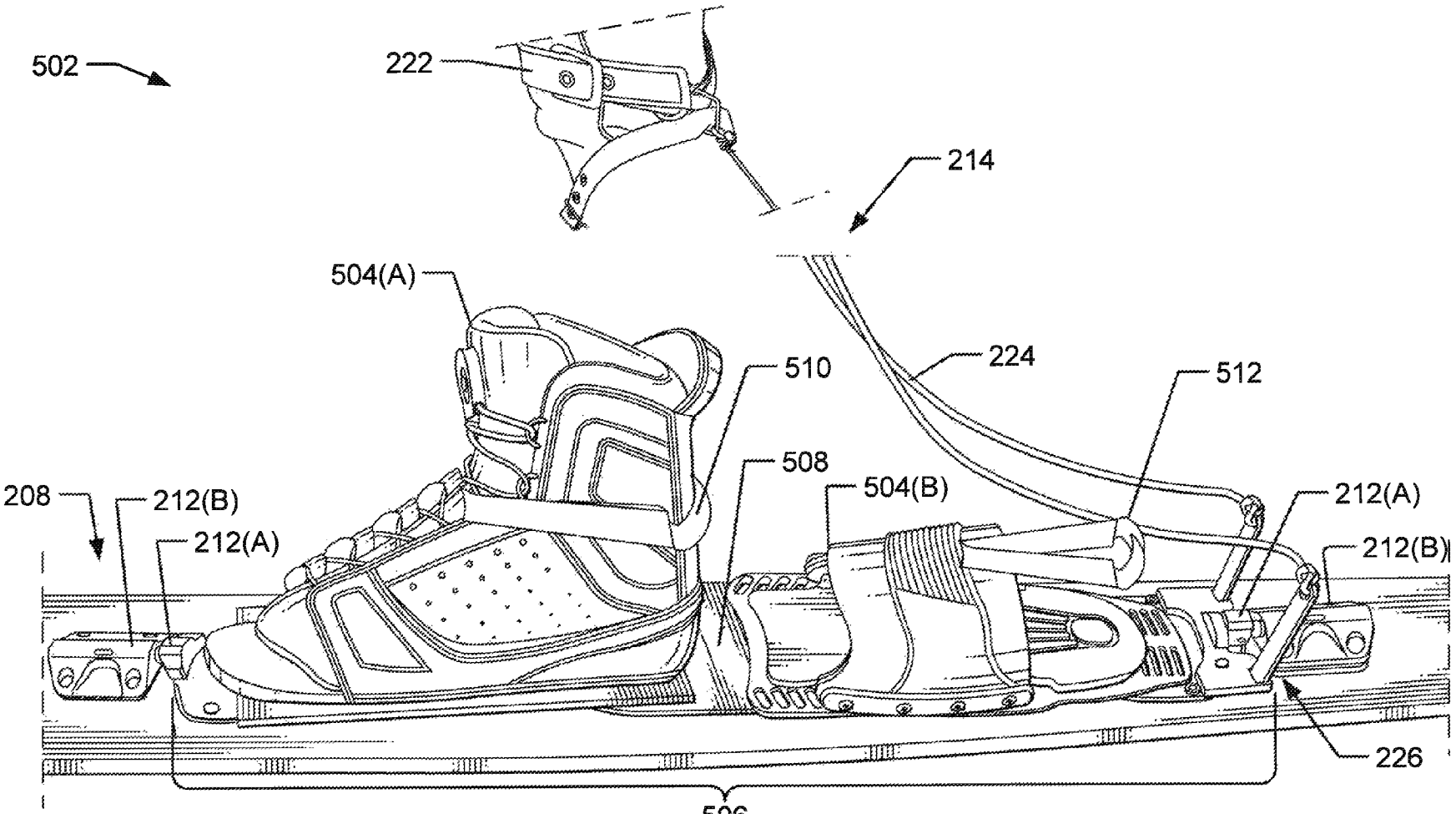
FIG. 5 illustrates a perspective view of another example water ski binding system that disconnects boots from a ski during the example COTF fall shown in FIG. 1.

FIG. 5 illustrates a perspective view of another example water ski binding system 502 that disconnects boots 504(A) and 504(B) from the ski 208 during the example COTF fall 102 shown in FIG. 1. FIG. 5 illustrates the water ski binding system 502 having a releasable unit 506 that disconnects the boots 504(A) and 504(B) from the ski 208 during the example COTF fall 102 shown in FIG. 1. The binding system 502 illustrated in FIG. 5 includes many of the same features as the water ski binding system 202 illustrated in FIG. 2. For example, the releasable binding system 502 includes the first binding component 212(A), the second binding component and 212(B), and the trigger mechanism 214.

FIG. 5 illustrates the first boot 504(A) comprising a soft boot fixed to a plate 508, and a safety strap 510 arranged with the first soft boot 504(A) to keep a front foot (not shown) of the skier 104 in the first soft boot 504(A). FIG. 5 illustrates the second boot 504(B) comprising a toe strap fixed to the plate 508, and another safety strap 512 arranged with the toe strap to keep a rear foot (not shown) of the skier 104 in the toe strap 506(B). While FIG. 5 illustrates the second boot 504(B) comprising a toe strap, the second boot 504(B) may comprise a soft boot. For example, the second boot 504(B) may comprise a soft boot fixed to the plate 508, and the soft boot fixed to the plate may include a safety strap to keep the rear foot of the skier in the rear soft boot.

Because the safety straps 510 and 512 keep the front and rear feet in the first and second boots 504(A) and 504(B), the risk of a twisting injury to ankles and knees is dramatically reduced. For example, because the safety straps 510 and 512 keep the front and rear feet in the first and second boots 504(A) and 504(B) fixed to the single plate 508, the legs of the skier are kept together preventing a single leg from twisting dramatically reducing the risk of twisting an ankle or a knee.

Figure 6:
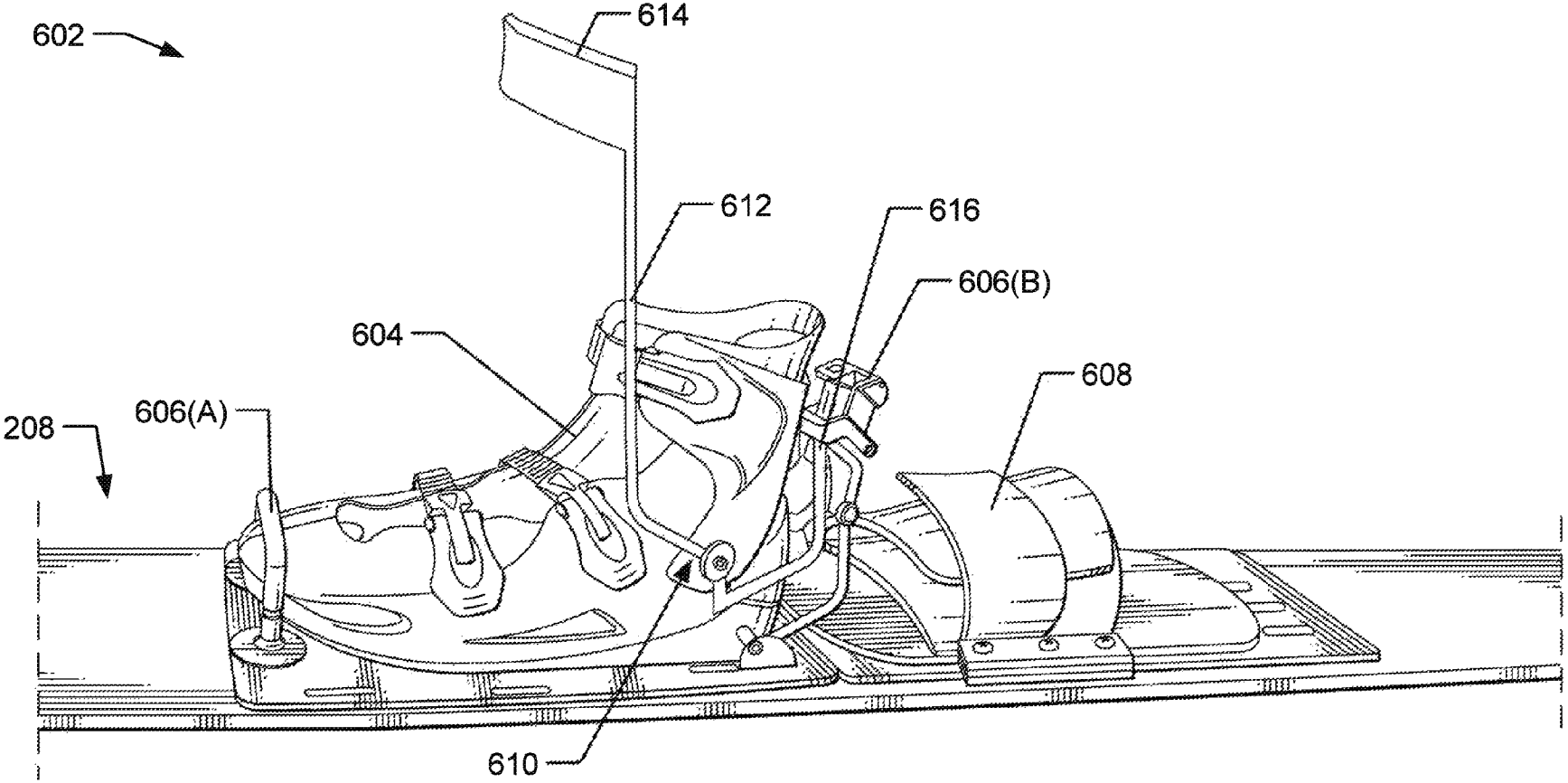
FIG. 6 illustrates a perspective view of another example water ski binding system that disconnects boots from a ski during the example COTF fall shown in FIG. 1.

FIG. 6 illustrates a perspective view of another example water ski binding system 602 that disconnects boots from the ski 208 during the example COTF fall 102 shown in FIG. 1. FIG. 6 illustrates the water ski binding system 602 having a releasable boot 604 that disconnects from the ski 208 during the example COTF fall 102 shown in FIG. 1. FIG. 6 illustrates a releasable binding system having a first binding component 606(A) arranged in front of a second binding component 606(B) for affixation to the ski 208, and to releasably couple the releasable boot 604 to the ski 208. While FIG. 6 illustrates a toe strap 608 fixed to the ski 208, the toe strap 608 may comprise a releasable boot or a soft boot. Moreover, while FIG. 6 illustrates the releasable binding system comprising a pivot-type releasable binding system (e.g., a "Revo" brand releasable binding system from Fluid Motion), the releasable binding system may comprise any releasable binding system configured to release a single boot from a ski. For example, the releasable binding system may comprise a pivot-type releasable binding system arranged to release a single boot from a ski, or a hook and loop-type release binding system arranged to release a single boot from a ski.

FIG. 6 illustrates the water ski binding system 602 having a trigger mechanism 610 to cause the releasable binding system to release the releasable boot 604 from the ski 208 based on the movement 402 of a knee of the skier through the distance 404 past an ankle below the knee. For example, the trigger mechanism 610 may include a lever 612 fixed to the releasable boot 604 arranged to interface with a portion of a leg of the skier. The lever 612 having a first end 614 arranged to interface with the portion of the leg of the skier, and a second end 616 arranged to interface with the second binding component 606(B). Moreover, the leg of the skier displaces the first end 614 of the lever 612, in response to the movement 402 of the knee of the skier through the distance 404 past the ankle below the knee, to cause the second end 616 of the lever 612 to displace the second binding component 606(B) to cause the releasable binding system to release the releasable boot 604 from the ski 208.

While FIG. 6 illustrates the trigger mechanism 610 comprising a lever 612 fixed to the releasable boot 604, the trigger mechanism 610 may comprise any mechanical sensor that senses when the knee is too far ahead of the ankle and converts that position to a force reduction mechanism that partially or wholly defeats a total load on a release mechanism to cause the releasable binding system to release the releasable boot 604 from the ski 208. For example, the trigger mechanism 610 may comprise a cable, a gear(s), a pivot or the like arranged to senses when the knee is too far ahead of the ankle and cause the releasable bindings to release the releasable boot 604 from the ski 208. For example, gears and/or levers may be arranged with the releasable boot 604 that measures a displacement (e.g., a rotation) of the leg and/or ankle inside the releasable boot 604. Moreover, while FIG. 6 illustrates the trigger mechanism 610 comprising mechanical sensor (i.e., lever 612) that senses when the knee 218 is too far ahead of the ankle 220 and converts that position to a force reduction mechanism that partially or wholly defeats a total load on a release mechanism to cause the releasable binding system to release the releasable boot 604 from the ski 208, the trigger mechanism may comprise an electromechanical sensor. For example, the trigger mechanism may comprise an electronic proximity sensor (e.g., an inductive sensor), a capacitive displacement sensor, a Hall effect sensor, an optical proximity sensor, a rotary encoder, a string potentiometer etc. that senses when the knee is too far ahead of the ankle and converts that position to a force reduction mechanism that partially or wholly defeats a total load on a release mechanism to cause the releasable binding system to release the releasable boot 604 from the ski 208.

CONCLUSION

Although the invention has been described in language specific to structural features and/or methodological acts, it is to be understood that the invention is not necessarily limited to the specific features or acts described. Rather, the specific features and acts are disclosed as illustrative forms of implementing the invention. For example, while embodiments are described having certain shapes, sizes, and configurations, these shapes, sizes, and configurations are merely illustrative.

What is claimed is:

1. A water ski binding system comprising:

releasable bindings to removeably couple a front boot to a water ski, the water ski having a tip opposite a tail; and a trigger mechanism to cause the releasable bindings to release the front boot from the water ski based at least in part on a displacement of a front knee of the skier past an ankle below the front knee in the front boot toward the tip of the water ski.

2. The water ski binding system of claim 1, wherein the trigger mechanism comprises:

a knee strap coupled to the front knee of the skier; and a member coupled to the knee strap and a release lever, wherein the member displaces the release lever, in response to the displacement of the front knee of the skier past the ankle below the front knee in the front boot toward the tip of the water ski, to cause the releasable bindings to decouple the front boot from the water ski.

3. The water ski binding system of claim 2, wherein the release lever comprises a lever arm and cam.

4. The water ski binding system of claim 1, wherein the trigger mechanism comprises:

a lever fixed to the front boot, the lever having a first end to interface with a portion of a leg of the skier, and a second end to interface with the releasable bindings; and wherein the leg of the skier displaces the lever, in response to the displacement of the front knee of the skier past the ankle below the front knee in the front boot toward the tip of the water ski, to cause the releasable bindings to decouple the front boot from the water ski.

5. The water ski binding system of claim 1, wherein the front boot comprises a hard boot arranged in front of another hard boot, the front boot comprises a soft boot arranged in front of another soft boot, or a toe strap, or the front boot comprises a hard boot arranged in front of a soft boot, or a toe strap.

6. A water ski boot system comprising:

a releasable unit having a first front boot arranged in front of a second rear boot and both the first front boot and the second rear boot boots are fixed to a plate;

a releasable binding system having a first binding component fixed to the releasable unit and a second binding component for affixation to a water ski having a tip opposite a tail, the first binding component and the second binding component being matable to releasably couple the releasable unit to the water ski; and a trigger mechanism to cause the releasable binding system to release the releasable unit from the water ski based on a movement of a front knee of the skier toward the tip of the water ski through a distance past an ankle arranged in the first front boot below the front knee.

7. The water ski boot system of claim 6, wherein the trigger mechanism comprises:

a lever fixed to the releasable unit; and a member couplable to the lever and to the front knee of the skier, wherein the member displaces the lever, in response to the movement of the front knee of the skier toward the tip of the water ski through the distance past the ankle arranged in the first front boot below the front knee, to cause the releasable binding system to release the releasable unit from the water ski.

8. The water ski binding system of claim 7, wherein the lever comprises a cam arranged between the plate and the water ski.

9. The water ski boot system of claim 6, wherein the first front boot and second rear boot comprise hard boots fixed to the plate.

10. The water ski boot system of claim 6, wherein:

the first front boot comprises a soft boot fixed to the plate, and a safety strap arranged with the first soft boot to keep a front foot of the skier in the first soft boot; and the second rear boot comprises a soft boot or a toe strap, and another safety strap arranged with the second soft boot or the toe strap to keep a rear foot of the skier in the second soft boot or the toe strap.

11. A water ski binding system comprising:

a releasable binding system having a first binding component fixed to a plate and second binding component for affixation to a water ski having a tip opposite a tail, the first binding component and the second binding component being matable to releasably couple the plate to the water ski; and a trigger mechanism to cause the releasable binding system to release the plate from the water ski based on a movement of a front knee of the skier toward the tip of the water ski through a distance past an ankle arranged in a front boot below the front knee.

12. The water ski binding system of claim 11, wherein the releasable binding system comprises a pin and socket releasable binding system.

13. The water ski binding system of claim 11, wherein the releasable binding system comprises a hook and loop releasable binding system.

14. A water ski boot system comprising:

a first front boot to be arranged in front of a second rear boot;

a releasable binding system having a first binding component arranged in front of a second binding component, the first binding component and the second binding component for affixation to a water ski having a tip opposite a tale, and the first binding component and the second binding component to releasably couple the first front boot to the water ski; and a trigger mechanism to cause the releasable binding system to release the first front boot from the water ski based on a movement of a front knee of the skier toward the tip of the water ski through a distance past an ankle arranged in the first front boot below the front knee.

15. The water ski boot system of claim 14, wherein the trigger mechanism comprises:

a lever fixed to the first front boot, the lever having a first end to interface with a portion of a leg of the skier, and a second end to interface with the second binding component; and wherein the leg of the skier displaces the first end of the lever, in response to the movement of the front knee of the skier toward the tip of the water ski through the distance past the ankle arranged in the first front boot below the front knee, to cause the second end of the lever to displace the rear binding component to cause the releasable binding system to release the first front boot from the water ski.

16. The water ski boot system of claim 14, wherein the releasable binding system comprises a pivot releasable binding system.

17. A slalom ski system comprising:

a water ski having a tip opposite a tail;

a front boot arranged on the water ski closer to the tip of the water ski than the tail of the water ski, and a rear boot arranged on the water ski closer to the tail of the water ski than the tip of the water ski;

releasable bindings removeably coupling the front boot to the water ski; and a trigger mechanism to cause the releasable bindings to release the front boot from the water ski based on a movement of a front knee of a skier toward the tip of the water ski through a distance past an ankle arranged in the front boot below the front knee.

18. The slalom ski system of claim 17, wherein:

the front boot comprises a first hard boot arranged in front of a second hard boot, and the first and second hard boots are fixed to a plate;

the releasable bindings having a first binding component fixed to the plate, and a second binding component fixed to the water ski; and the trigger mechanism comprises a lever fixed to the plate, and a member couplable to the lever and to the front knee of the skier, wherein the member displaces the lever, in response to the movement of the front knee of the skier toward the tip of the water ski through the distance past the ankle arranged in the first hard boot below the front knee, to cause the releasable bindings to release the plate from the water ski.

19. The slalom ski system of claim 17, wherein:

the front boot comprises a first soft boot arranged in front of a second soft boot or a toe strap, and the first soft boot is fixed to a plate, and the second soft boot or the toe strap is fixed to the plate;

the releasable bindings having a first binding component fixed to the plate, and a second binding component fixed to the water ski; and the trigger mechanism comprises a lever fixed to the plate, and a member couplable to the lever and to the knee of the skier, wherein the member displaces the lever, in response to the movement of the front knee of the skier toward the tip of the water ski through the distance past the ankle arranged in the first soft boot below the front knee, to cause the releasable bindings to release the plate from the water ski.

20. The slalom ski system of claim 19, further comprising:

a first safety strap arranged with the first soft boot to keep a front foot of the skier in the first soft boot; and a second safety strap arranged with the second soft boot or the toe strap to keep a rear foot of the skier in the second soft boot or the toe strap.

21. The slalom ski system of claim 17, wherein:

the front boot comprises a first hard boot arranged in front of a second boot;

the releasable bindings comprise a first binding component arranged in front of a second binding component, the first and second binding components fixed to the water ski;

the trigger mechanism comprises a lever fixed to the first hard boot removeably coupled to the water ski, the lever having a first end to interface with a portion of a leg of the skier, and a second end to interface with the second binding component; and wherein the leg of the skier displaces the first end of the lever, in response to the movement of the front knee of the skier toward the tip of the water ski through the distance past the ankle arranged in the first hard boot below the first knee, to cause the second end of the lever to displace the second binding component to cause the releasable bindings to release the first hard boot from the water ski.

* * * * *